US006457313B1

(12) United States Patent
Fujii

(10) Patent No.: US 6,457,313 B1
(45) Date of Patent: Oct. 1, 2002

(54) PRESSURE AND FLOW RATE CONTROL APPARATUS AND PLANT SYSTEM USING THE SAME

(75) Inventor: Fuminori Fujii, Hyogo-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/007,699

(22) Filed: Dec. 10, 2001

(30) Foreign Application Priority Data

May 21, 2001 (JP) ..... 2001-151660

(51) Int. Cl.[7] ..... F01K 7/34
(52) U.S. Cl. ..... 60/653; 60/670; 415/17
(58) Field of Search ..... 60/653, 670; 415/17

(56) References Cited

U.S. PATENT DOCUMENTS 3,878,692 A * 4/1975 Steves ..... 62/87
4,833,880 A * 5/1989 Chapin ..... 60/39.281
5,038,568 A * 8/1991 Gounder et al. ..... 60/679
5,363,828 A * 11/1994 Yamashita ..... 123/520
5,954,034 A * 9/1999 Takagi ..... 123/520

FOREIGN PATENT DOCUMENTS

JP 7-54672 2/1995

* cited by examiner

*Primary Examiner*—Hoang Nguyen
(74) *Attorney, Agent, or Firm*—Armstrong, Westerman & Hattori, LLP

(57) ABSTRACT

A pressure and flow control apparatus includes first to third pipes, fluid being supplied to the first pipe and outputted from the third pipe, a pressure control valve, a control valve, and a control unit. The pressure control valve is provided between the first and second pipes and opened or closed based on a first opening degree to control flow of the fluid from the second pipe to the third pipe. The control valve is provided between the second and third pipes and opened or closed based on a second opening degree to control flow of the fluid from the first pipe to the second pipe. The control unit determines the first opening degree, and determines the second opening degree based on the first opening degree and a pressure in the second pipe.

24 Claims, 4 Drawing Sheets

PRESSURE AND FLOW RATE CONTROL APPARATUS AND PLANT SYSTEM USING THE SAME

BACKGROUND OF THE INVENTION

1. Field of the Invention

The present invention relates to a pressure and flow control apparatus, and a plant system using the same. More particularly, the present invention relates to a pressure and flow control apparatus in which a pressure control valve is connected with another control valve in series.

2. Description of the Related Art

To control a pressure and a physical quantity of fluid at the same time, a pressure control valve and anther control valve are connected in series.

FIG. 1 shows a conventional pressure and flow control apparatus. Referring to FIG. 1, the conventional pressure and flow control apparatus is composed of a pressure control valve 101 and a flow rate control valve 102. A pipe 103 is connected with the input side of the pressure control valve 101. A pipe 104 is connected between the output side of the pressure control valve 101 and the input side of the flow rate control valve 102. The output side of the flow rate control valve 102 is connected with a pipe 105. The fluid is introduced into the pipe 103, and is led to the pipe 104 through the pressure control valve 101. Then, the fluid in the pipe 104 is led to the pipe 105 through the flow rate control valve 102.

The opening degree of the pressure control valve 101 is controlled by a pressure gauge 106, a difference unit 107 and a pressure control unit 108. The pressure gauge 106 measures the pressure $X_P$ in the pipe 104. The difference unit 107 calculates the difference between the measured pressure $X_P$ and a reference pressure $R_P$ to obtain a deviation $E_P$. The degree $U_P$ of the pressure control valve 101 based on the deviation $E_P$. The opening degree of the pressure control valve 101 is set to the determined opening degree $U_P$. As a result, the pressure $X_P$ of the pipe 104 is controlled to be coincident with the reference pressure $R_P$.

Also, the opening degree of the flow control valve 102 is controlled by a flowmeter Fx 109, a difference unit 111, and a flow control unit 112. The flowmeter FX 109 measures the flow rate $X_F$ of the fluid flowing through the pipe 105. The difference unit 111 calculates a difference between the measured flow rate $X_F$ and a reference flow rate $R_F$ to obtain a deviation $E_F$. The flow control unit 112 determines the opening degree $U_F$ of the flow control valve 102 based on the deviation $E_F$. The opening degree of the flow control valve 102 is set to the determined opening degree $U_F$. As a result, the flow rate $X_F$ of the fluid flowing through the pipe 105 is controlled to be coincident with the reference flow rate $R_F$.

In the above-mentioned pressure and flow control apparatus, the opening degree of the flow control valve 102 has an influence on the pressure XP of the pipe 104 which depends on the opening degree of the pressure control valve 101. Therefore, it is desirable that the pressure XP of the pipe 104 is controlled, considering such an influence.

Especially, when the opening degree of the flow control valve 102 is small, the pressure control valve 101 often repeats a switching operation between a small opened state and a full closed state. The repetition causes the damage and abrasion of a valve sheet of the pressure control valve 101. Therefore, it is desirable that the repetition of the switching operation is not carried out in the pressure control valve 101, even if the opening degree of the flow control valve 102 is small.

In conjunction with the above description, a fuel flow rate control apparatus for a turbine is disclosed in Japanese Laid Open Patent application (JP-A-Heisei 7-54672). In this reference, a fuel-adjusting pipe is connected to a fuel supply system and has a closed portion at one end and a fuel-blowing hole on a side portion. A casing is provided around the fuel-adjusting pipe and connected with a fuel consuming system. A flap valve is provided near the fuel-blowing hole to be movable in a longitudinal direction of the fuel-adjusting pipe for setting an opening quantity of the fuel-blowing hole. A position sensor detects the position of the flap valve. A torque motor is connected to the position sensor and the flap valve and drives the flap valve based on a fuel instruction value and position detection data by the position sensor.

SUMMARY OF THE INVENTION

Therefore, an object of the present invention is to provide a pressure and flow control apparatus in which a pressure control valve is connected to another control valve in series, and the opening degree of the pressure control valve is controlled considering the opening degree of the other control valve.

Another object of the present invention is to provide a pressure and flow control apparatus in which a pressure control valve is connected to another control valve in series, and the pressure control valve does not repeat a switching operation between a small open state and a full close state even if the opening degree of the other control valve is small.

Still another object of the present invention is to provide a pressure and flow control apparatus in which a pressure control valve is connected to another control valve in series, and a damage and abrasion of a valve sheet of the pressure control valve can be prevented.

Yet still another object of the present invention is to provide a plant system having any of the above pressure and flow control apparatuses.

In an aspect of the present, a pressure and flow control apparatus includes first to third pipes, fluid being supplied to the first pipe and outputted from the third pipe, a pressure control valve, a control valve, and a control unit. The pressure control valve is provided between the first and second pipes and opened or closed based on a first opening degree to control flow of the fluid from the second pipe to the third pipe. The control valve is provided between the second and third pipes and opened or closed based on a second opening degree to control flow of the fluid from the first pipe to the second pipe. The control unit determines the first opening degree, and determines the second opening degree based on the first opening degree and a pressure in the second pipe.

Here, the control unit preferably determines the first opening degree based on a physical parameter. In this case, the control unit may include a detecting unit provided for the third pipe to detect the physical parameter. Otherwise, the control unit may include a detecting unit provided for an output of a unit which operates using the fluid outputted from the third pipe, to detect the physical parameter. The physical parameter is one of temperature and flow rate.

Also, the control unit may determine the first opening degree based on the physical parameter and a first reference value.

Also, the control unit may include a pressure-detecting unit which detects the pressure in the second pipe.

Also, the control unit may determine the second opening degree such that the second pressure control valve is always opened as far as the control valve is opened.

In another aspect of the present invention, a pressure and flow control apparatus includes first to third pipes, fluid being supplied to the first pipe and outputted from the third pipe, a pressure control valve, a control valve and a control unit. The pressure control valve is provided between the first and second pipes and opened or closed based on a first opening degree to control flow of the fluid from the second pipe to the third pipe. The control valve is provided between the second and third pipes and opened or closed based on a second opening degree to control flow of the fluid from the first pipe to the second pipe. The control unit determines the first opening degree, determines a first temporary opening degree based on the first opening degree, determines a second temporary opening degree based on a pressure in the second pipe, and determines the second opening degree based on the first and second temporary opening degrees.

Here, the control unit may include a function unit which outputs the first temporary opening degree based on the first opening degree. In this case, the function unit may output the first temporary opening degree of a value depending on the first opening degree in a first range of the first opening degree. It is preferable that the value depending on the first opening degree monotonously increases depending on increase of the first opening degree. Also, the function unit may output the first temporary opening degree of a constant value in a second range of the first opening degree between 0 and the first range of the first opening degree.

Also, the control unit may include a selector which selects one of the first and second temporary opening degrees as the second opening degree.

Also, the control unit may include a pressure-calculating unit which determines the second temporary opening degree based on the pressure in the second pipe and a reference pressure.

Also, the control unit may include a detecting unit which detects a physical parameter which is influenced by the control valve, and a calculating unit which determines the first opening degree based on the detected physical parameter and a reference value.

In still another aspect of the present invention, a gas turbine system includes a gas turbine which operates using a fuel gas, and a pressure and flow control apparatus. The pressure and flow control apparatus has a pressure control valve and a flow rate control valve which are connected in series. The pressure and flow control apparatus controls a first opening degree of the flow rate control valve to control a flow rate of the fuel gas supplied to the gas turbine, and controls a second opening degree of the pressure control valve based on a pressure of the fuel gas on an output side of the pressure control valve and the first opening degree such that the pressure of the fuel gas supplied to the gas turbine is controlled.

Here, the control unit may determine the first opening degree of the flow rate control valve based on the flow rate of the fuel gas supplied to the gas turbine. Also, the control unit may determine a first temporary opening degree based on the first opening degree, determine a second temporary opening degree based on the pressure on the output side of the pressure control valve, and determine the second opening degree based on the first and second temporary opening degrees.

Also, the control unit may determine the second opening degree such that the second pressure control valve is always opened as far as the control valve is opened.

Also, the control unit may include a selector which selects one of the first and second temporary opening degrees as the second opening degree.

In yet still another aspect of the present invention, a steam turbine system includes a steam turbine, a bypass section, a boiler, and a pressure and flow control apparatus. The steam turbine includes a first turbine operating using a main steam and then outputting low temperature re-heated steam, and a second turbine operating high temperature re-heated steam. The bypass section has a cooler using water to cool a part of the main steam and to produce the low temperature re-heated steam. The boiler generates the main steam to supply to the steam turbine and heats the low temperature re-heated steam from the steam turbine and the bypass section to produce and supply the high temperature re-heated steam to the steam turbine. The pressure and flow control apparatus has a pressure control valve and a temperature control valve which are connected in series. The control apparatus controls a first opening degree of the temperature control valve based on a temperature of an output of the cooler such that supply of the water to the cooler is controlled, and controls a second opening degree of the pressure control valve based on a pressure on an output side of the pressure control valve and the first opening degree such that the pressure of the water supplied to the cooler is controlled.

Also, the control unit may determine the first opening degree of the flow rate control valve based on the temperature of the output of the cooler, determine a first temporary opening degree based on the first opening degree, determine a second temporary opening degree based on the pressure on the output side of the pressure control valve, and determine the second opening degree based on the first and second temporary opening degrees.

Also, the control unit may determine the second opening degree such that the second pressure control valve is always opened as far as the temperature control valve is opened.

Also, a selector selects one of the first and second temporary opening degrees as the second opening degree.

DESCRIPTION OF THE PREFERRED EMBODIMENTS

Hereinafter, a pressure and flow control apparatus of the present invention and a plant system such as a gas turbine system and a steam turbine system to which the pressure and flow control apparatus will be described below in detail with reference to the attached drawings.

Figure 1:
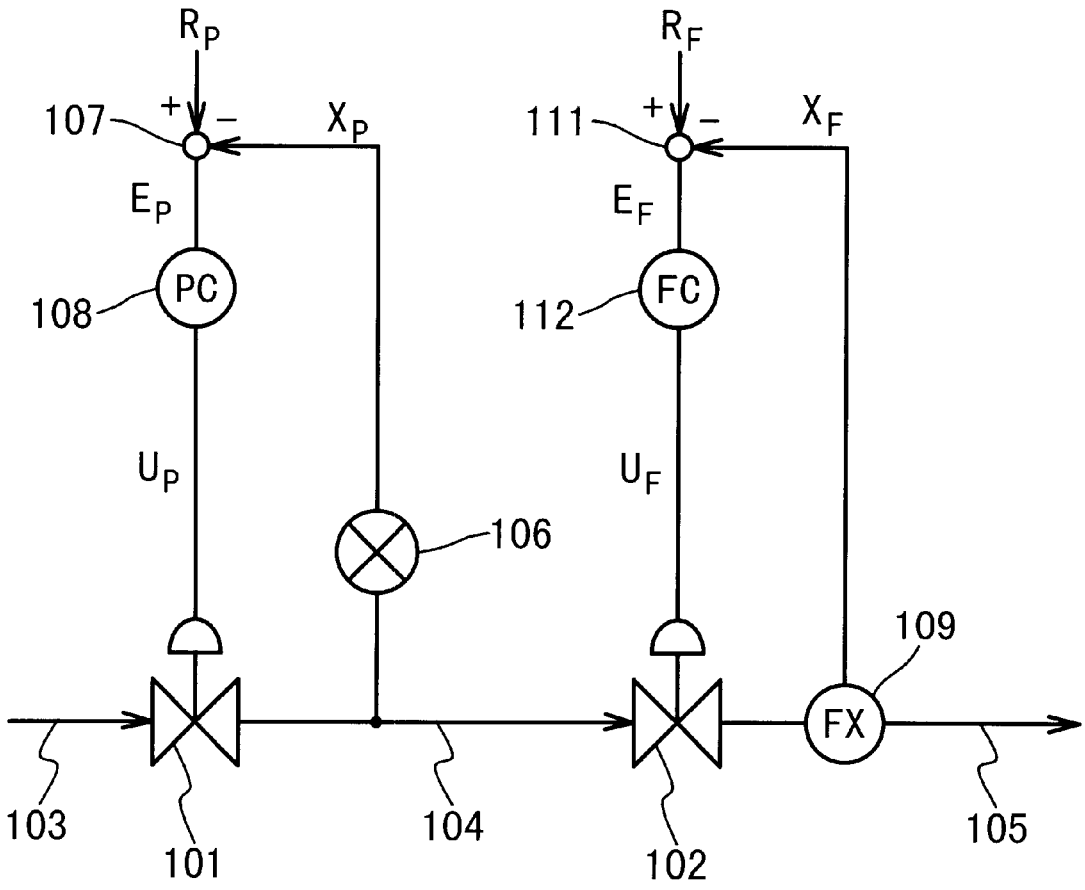
Fig. 1 PRIOR ART
FIG. 1 is a diagram showing a conventional pressure and flow control apparatus.
Figure 2:
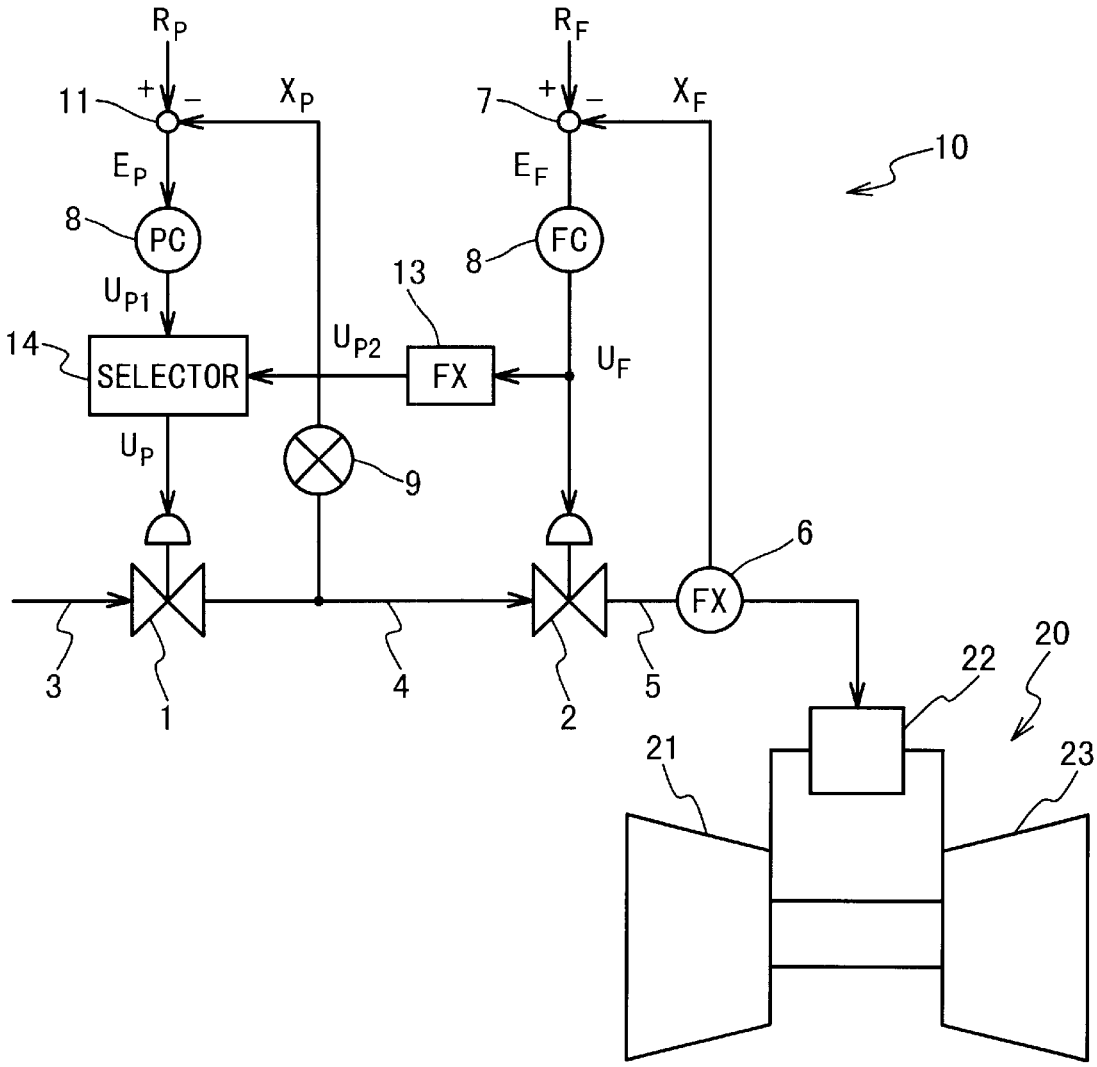
FIG. 2 is a diagram showing a gas turbine system to which a pressure and flow control apparatus according to a first embodiment of the present invention is applied.

FIG. 2 shows a gas turbine system with a pressure and flow control apparatus 10 according to the first embodiment of the present invention and a gas turbine 20. The pressure and flow control apparatus 10 supplies fuel to the gas turbine 20. The gas turbine 20 generates power with the supplied fuel.

The gas turbine 20 is composed of a compressor 21, a combustion unit 22 and a turbine 23. The compressor 21 sucks and compresses air to produce compressed air. The compressed air is supplied to the combustion unit 22. The combustion unit 22 combusts the fuel supplied from the pressure and flow control apparatus 10 using the compressed gas to produce combustion gas. The turbine 23 is driven by the combustion gas.

The pressure and flow control apparatus 10 contains a pressure control valve 1 and a flow rate control valve 2. A pipe 3 is connected with the input side of the pressure control valve 1. A pipe 4 is connected with the output side of the pressure control valve 1, and with the input side of the flow rate control valve 2. The output side of the flow rate control valve 2 is connected with a pipe 5.

Fluid as fuel is introduced into pipe 3, and led to a pipe 5 through the pressure control valve 1, and a pipe 4 and the flow rate control valve 2. Then, the fuel is supplied from the pipe 5 to the gas turbine 20 through a flowmeter 6.

The opening degree of the flow control valve 2 is controlled by the flowmeter 6, a difference unit 7, and a flow control unit 8. The flowmeter 6 measures the flow rate $X_F$ of the fuel flowing through the pipe 5. The difference unit 7 calculates a difference between the measured flow rate $X_F$ and a reference flow rate $R_F$ to obtain a deviation $E_F$. The flow control unit 8 controls the opening degree $U_F$ of the flow control valve 2 based on the deviation $E_F$ such that the flow control valve 2 has the opening degree $U_F$. As a result, the flow rate $X_F$ of the fuel flowing through the pipe 5 is adjusted to be coincident with the reference flow rate $R_F$.

The opening degree of the pressure control valve 1 is controlled by a pressure gauge 9, a difference unit 11, a pressure control unit 12, and a function unit 13. The pressure gauge 9 measures the pressure $X_P$ of the fuel flowing through the pipe 4. The difference unit 11 calculates the difference of the measured pressure $X_P$ and a reference pressure $R_P$ to obtain a deviation $E_P$. The pressure control unit 12 calculates a first temporal opening degree $U_{P1}$ for the pressure control valve 1 based on the deviation $E_P$. On the other hand, the function unit 13 calculates a second temporal opening degree $UP_2$ for the pressure control valve 1 based on the above-mentioned opening degree $U_F$ of the flow control valve 2.

Figure 3:
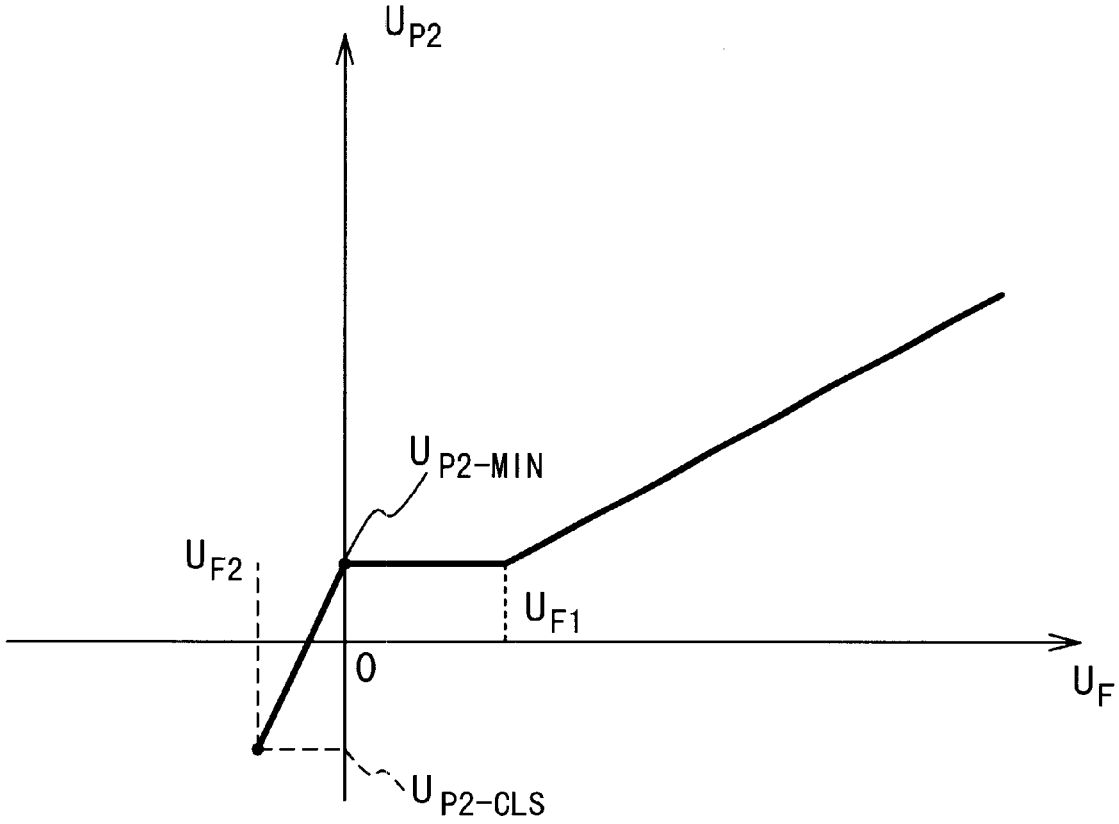
FIG. 3 is a graph showing a relation of the opening degree $U_{P2}$ of a pressure control valve divergence calculated by a function unit and the opening degree $U_F$ of a flow control valve.

FIG. 3 shows a relation of the opening degree $U_F$ of the flow control valve 2 and the second temporary opening degree $U_{P2}$ for the pressure control valve 1 determined by the function unit 13. Referring to FIG. 3, the second temporary opening degree $U_{P2}$ for the pressure control valve 1 has the minimum value $U_{P2-MIN}$ and increases monotonously with the increase of the opening degree $U_F$, in the opening degree region of $U_F \geqq 0$. In the first embodiment, the following relations are satisfied:

$$U_{P2}=U_{P2-MIN}>0(0 \leqq U_F \leqq U_{F1})$$

$$U_{P2}=f_1(U_F-U_{F1})+U_{P2-MIN}(U_{F1} \leqq U_F)$$

where $f_1(x)$ satisfies $f_1(0)=0$ and the function value increases monotonously in $x>0$. The second temporary opening degree $U_{P2}$ for the pressure control valve 1 is set in this way. Therefore, the second temporary opening degree $U_{P2}$ for the pressure control valve is never smaller than the minimum opening degree $U_{P2-MIN}$ in the region of $U_F \leqq 0$. Also, the second opening degree $U_{P2}$ satisfies the following relation in $U_{F2} \leqq U_F<0$:

$$U_{P2}=f_2(U_{F2})\cdot U_F+U_{P2-MIN}$$

where $f_2(x)$ is a monotonously increasing function in which $f_2(U_{F2})=U_{P2-CLS}$, $f(U_{F3})=0$, and $f_2(0)=U_{P2-MIN}$, and $U_{P2-CLS}<0$ and $U_{F3}<0$.

In the above description, a positive value of the opening degree U represents that the valve is opened, and a larger opening degree value U represents that the opening degree U of the valve is larger. The opening degree U of 0 represents that the valve is closed and is contact with a valve sheet without any pressure. A negative value of the opening degree U represents that the valve is contact with the valve sheet with a pressure. In this case, the contact pressure with the valve sheet becomes larger when an absolute value of the opening degree U is larger. Therefore, the second temporary opening degree $U_{P2}$ for the pressure control valve 1 is $U_{F2}<0$ in the region of $U_{F2} \leqq U_F<U_{F3}$. That is, in the region of $U_{F2} \leqq U_F<U_{F3}$, the pressure control valve 1is closed and there is a contact pressure with the valve sheet.

The first temporary opening degree $U_{P1}$ of the pressure control valve 1 determined by the pressure control unit 12 and the second temporary opening degree $U_{P2}$ for the pressure control valve 1 determined by the function unit 13 are supplied to a selector 14. The selector 14 compares the first temporary opening degree $U_{P1}$ and the second temporary opening degree $U_{P2}$ and selects the larger one as the opening degree of the pressure control valve 1. The selected opening degree $U_P$ is supplied to the pressure control valve 1 as a pressure control signal. The pressure control valve 1 is set to the selected opening degree $U_P$ in response to the pressure control signal.

In this way, the set opening degree $U_P$ of the pressure control valve never becomes smaller than $U_{P2-MIN}$ as far as the opening degree $U_F$ of the flow control valve 2 is equal to or larger than 0. Therefore, the pressure control valve 1 never repeats a switching operation between a small opened degree state and a full closed state even when the opening degree $U_F$ of the flow control valve 2 is small. Thus, in the pressure and flow control apparatus 10 of the first embodiment, the damage and abrasion of the pressure control valve 1 can be prevented.

Figure 4:
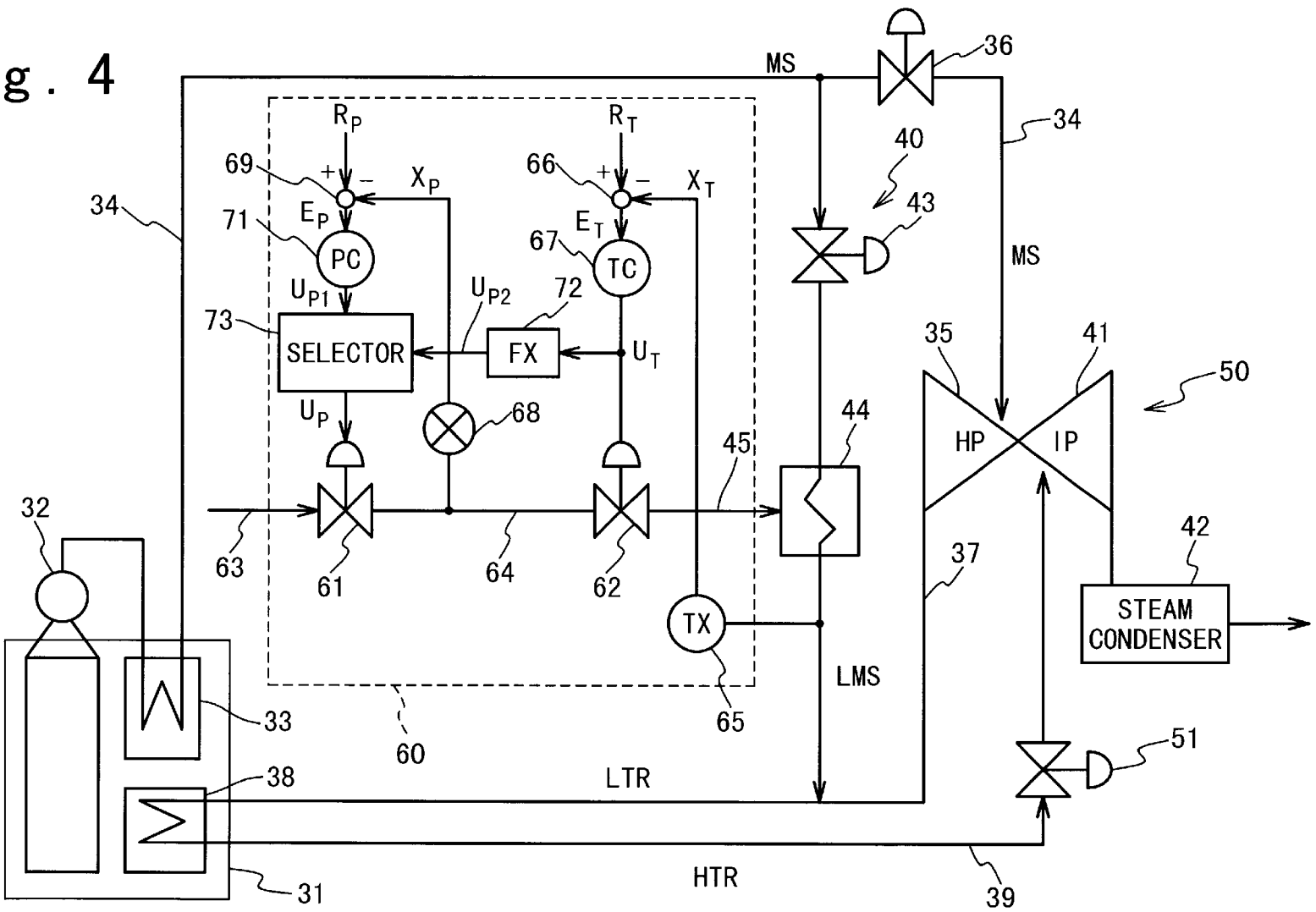
FIG. 4 is a diagram showing a steam turbine system to which the pressure and flow control apparatus according to a second embodiment of the present invention is applied.

Next, a steam turbine system to which the pressure and flow control apparatus of the second embodiment of the present invention is applied will be described. FIG. 4 shows the steam turbine system. The pressure and flow control apparatus 60 in the second embodiment controls water supply for the temperature adjustment in the steam turbine system.

Referring to FIG. 4, the steam turbine system is composed of a boiler 31. The boiler 31 is composed of a drum 32, a superheater 33 and a reheater 38. The drum 32 generates and supplies steam to the superheater 33. The superheater 33 heats the steam more and generates a main steam MS. The main steam MS is supplied to a high-pressure turbine HP 35 of a turbine 50 through a main steam pipe 34. A conductance valve 36 is interposed on the way of the main steam pipe 34. The conductance valve 36 adjusts the conductance of the main steam pipe 34. The high-pressure turbine HP 35 generates power using the main steam MS supplied through the main steam pipe 34. The high-pressure turbine HP 35 exhausts low temperature re-heated steam LTR into a low temperature re-heated steam pipe 37. The low temperature reheated steam LTR is lower in temperature than the main steam MS. The low temperature re-heated steam pipe 37 leads the low temperature re-heated steam LTR to the reheater 38 provided in the boiler 31. The reheater 38 heats the low temperature re-heated steam LTR and generates a high temperature re-heated steam HTR. The high temperature re-heated steam HTR is supplied to an intermediate-pressure turbine IP 41 of the turbine 50 through a high temperature re-heated steam pipe 39. A conductance valve 51 is interposed on the way of the high temperature re-heated steam pipe 39. The conductance valve 51 adjusts the conductance of the high temperature re-heated steam pipe 39. The intermediate-pressure turbine IP 41 generates power using the high temperature re-heated steam HTR supplied through the high temperature re-heated steam pipe 39. The intermediate-pressure turbine IP 41 exhausts the remaining steam to a steam condenser 42. The steam condenser 42 cools the exhausted steam and collects water. For example, the power generated by the high-pressure turbine HP 35 and the middle-pressure turbine IP 41 is used for the generation of electricity.

A bypass line 40 is provided between the above-mentioned main steam pipe 34 and the low temperature re-heated steam pipe 37. The bypass line 40 and the pressure and flow control apparatus 60 in the second embodiment form a steam bypass system. The bypass line 40 bypasses a part of the main steam MS to the low temperature re-heated steam pipe 37 to adjust the pressure of the main steam pipe 34. A main steam pressure adjusting valve 43 and a cooler 44 are provided on the bypass line 40. The main steam pressure adjusting valve 43 supplies a part of the main steam MS to the cooler 44. The pipe 45 is connected to the cooler 44. Water is supplied to the cooler 44 from the pressure and flow control apparatus 60 through the pipe 45. The cooler 44 uses the water as coolant and cools the part of the main steam MS to generate the low temperature main steam LMS. The low temperature main steam LMS is introduced into the above-mentioned low temperature re-heated steam pipe 37.

The pressure and flow control apparatus 60 supplies the water to the cooler 44 and adjusts the flow rate of the water such that the temperature of the low temperature main steam LMS becomes equal to a reference temperature $R_T$. The pressure and flow control apparatus 60 contains a pressure control valve 61 and a temperature control valve 62. A pipe 63 is connected with the input side of the pressure control valve 61. A pipe 64 is connected with the output side of the pressure control valve 61 and with the input side of the temperature control valve 62. The output side of the temperature control valve 62 is connected with the above-mentioned pipe 45.

The water is introduced into the pipe 63. The water in the pipe 63 is led into the pipe 64 through the pressure control valve 61. Then, the water in the pipe 64 is led through the temperature control valve 62 into the pipe 45 connected with the cooler 44. Finally, the water in the pipe 45 is supplied to the cooler 44.

The opening degree of the temperature control valve 62 is controlled by a thermometer 65, a difference unit 66, and a temperature control unit 67. The thermometer 65 measures the temperature $X_T$ of the low temperature main steam LMS cooled by the cooler 44. The difference unit 66 calculates a difference between the measured temperature $X_T$ and the reference temperature $R_T$ to obtain a deviation $E_T$. The temperature control unit 8 determines the opening degree $U_T$ of the temperature control valve 62 based on the deviation $E_T$. The temperature control valve 62 is controlled to have the determined opening degree $U_T$. As a result, the flow rate of the water supplied to the cooler 44 is controlled such that the temperature $X_T$ of the low temperature main steam LMS is coincident with the reference temperature $R_T$.

On the other hand, the opening degree of the pressure control valve 61 is controlled by a pressure gauge 68, a difference unit 69, a pressure control unit 71, a function unit 72 and a selector 73. The pressure gauge 68 measures the pressure $X_P$ of the water flowing through the pipe 64. The difference unit 69 calculates the difference of the measured pressure $X_P$ and a reference pressure $R_P$ to obtain a deviation $E_P$. The pressure control unit 71 calculates a first temporary opening degree $U_{P1}$ of the pressure control valve 61 based on the deviation $E_P$. On the other hand, the function unit 72 calculates a second temporary opening degree $U_{P2}$ of the pressure control valve 61 based on the opening degree $U_T$ of the temperature control valve 62. The function unit 72 operates in the same way as the function unit 13 in the first embodiment except that its input is the opening degree $U_T$ of the temperature control valve 62. Therefore, the description of the operation is omitted. Like the first embodiment, the second temporary opening degree $U_{P2}$ of the pressure control valve 62 determined by the function unit 72 has a value $U_{P2-MIN}$ as the minimum value and increases monotonously in the region of $U_T \leqq 0$. Thus, the second temporary opening degree $U_{P2}$ never becomes smaller than $U_{P2-MIN}$.

The selector 73 compares the first temporary opening degree $U_{P1}$ and the second temporary opening degree $U_{P2}$ of the pressure control valve 61 and determines the larger one as an opening degree $U_P$ of the pressure control valve 61. The determined opening degree $U_P$ for the pressure control valve 61 is supplied to the pressure control valve 61 as a pressure control signal. The opening degree of the pressure control valve 61 is set to the opening degree $U_P$ in response to the pressure control signal.

In this way, the determined opening degree $U_P$ of the pressure control valve 61 never becomes smaller than the minimum opening degree $U_{P2-MIN}$ as far as the opening degree $U_T$ of the temperature control valve 62 is equal to or larger than 0. Therefore, the pressure control valve 61 never repeats a switching operation between a small opened state and a full closed state even when the opening degree $U_F$ of the temperature control valve 62 is small. Thus, the damage and abrasion of the pressure control valve 61 can be prevented.

As described above, the pressure and flow control apparatus 60 in the second embodiment controls the flow rate of the water supplied to the cooler 44 such that the temperature of the low temperature main steam LMS produced by the cooler 44 is constant. At this time, the pressure control valve 61 never repeats the switching operation between a small open state and a full close state even when the opening degree $U_F$ of the temperature control valve 62 is small.

It should be noted that the selector of the pressure and flow control apparatus may be replaced by a function unit (not shown) which operates in the same way as the selector.

Also, such a function unit may operates in such a way that the first and second temporary opening degrees are weighted by coefficients w1 and w2 and the opening degree UP is determined based on a sum of the weighted ones of the first and second temporary opening degrees. In this case, the determined opening degree UP may have a minimum value in a range where the sum is small.

According to the pressure and flow control apparatus of the present invention, a pressure control valve is connected in series with another control valve through a pipe on the downstream side of the pressure control valve. The opening degree of the pressure control valve is controlled in consideration of the influence of the opening degree of the other control valve to the pressure control valve.

Also, in the present invention, even if the opening degree of the other control valve is small, the pressure control valve never repeat a switching operation between a small open state and a full close state.

In this way, the damage and the abrasion of the valve sheet of the pressure control valve can be prevented.

What is claimed is:

1. A pressure and flow control apparatus comprising:

first to third pipes, fluid being supplied to said first pipe and outputted from said third pipe;

a pressure control valve provided between said first and second pipes and opened or closed based on a first opening degree to control flow of said fluid from said second pipe to said third pipe;

a control valve provided between said second and third pipes and opened or closed based on a second opening degree to control flow of said fluid from said first pipe to said second pipe; and a control unit which determines said first opening degree, and determines said second opening degree based on said first opening degree and a pressure in said second pipe.

2. The pressure and flow control apparatus according to claim 1, wherein said control unit determines said first opening degree based on a physical parameter.

3. The pressure and flow control apparatus according to claim 2, wherein said control unit comprises:

a detecting unit provided for said third pipe to detect said physical parameter.

4. The pressure and flow control apparatus according to claim 2, wherein said control unit comprises:

a detecting unit provided for an output of a unit which operates using said fluid outputted from said third pipe, to detect said physical parameter.

5. The pressure and flow control apparatus according to claim 2, wherein said physical parameter is one of temperature and flow rate.

6. The pressure and flow control apparatus according to claim 2, wherein said control unit determines said first opening degree based on said physical parameter and a first reference value.

7. The pressure and flow control apparatus according to claim 1, wherein said control unit comprises:

a pressure detecting unit which detects said pressure in said second pipe.

8. The pressure and flow control apparatus according to claim 1, wherein said control unit determines said second opening degree such that said second pressure control valve is always opened as far as said control valve is opened.

9. A pressure and flow control apparatus comprising:

first to third pipes, fluid being supplied to said first pipe and outputted from said third pipe;

a pressure control valve provided between said first and second pipes and opened or closed based on a first opening degree to control flow of said fluid from said second pipe to said third pipe;

a control valve provided between said second and third pipes and opened or closed based on a second opening degree to control flow of said fluid from said first pipe to said second pipe; and a control unit which determines said first opening degree, determines a first temporary opening degree based on said first opening degree, determines a second temporary opening degree based on a pressure in said second pipe, and determines said second opening degree based on said first and second temporary opening degrees.

10. The pressure and flow control apparatus according to claim 9, wherein said control unit comprises:

a function unit which outputs said first temporary opening degree based on said first opening degree.

11. The pressure and flow control apparatus according to claim 10, wherein said function unit outputs said first temporary opening degree of a value depending on said first opening degree in a first range of said first opening degree.

12. The pressure and flow control apparatus according to claim 11, wherein said value depending on said first opening degree monotonously increases depending on increase of said first opening degree.

13. The pressure and flow control apparatus according to claim 11, wherein said function unit outputs said first temporary opening degree of a constant value in a second range of said first opening degree between 0 and said first range of said first opening degree.

14. The pressure and flow control apparatus according to claim 11, wherein said control unit comprises:

a selector which selects one of said first and second temporary opening degrees as said second opening degree.

15. The pressure and flow control apparatus according to claim 11, wherein said control unit comprises:

a pressure calculating unit which determines said second temporary opening degree based on said pressure in said second pipe and a reference pressure.

16. The pressure and flow control apparatus according to claim 9, wherein said control unit comprises:

a detecting unit which detects a physical parameter which is influenced by said control valve; and a calculating unit which determines said first opening degree based on the detected physical parameter and a reference value.

17. A gas turbine system comprising:

a gas turbine which operates using a fuel gas; and a pressure and flow control apparatus which has a pressure control valve and a flow rate control valve which are connected in series, controls a first opening degree of said flow rate control valve to control a flow rate of said fuel gas supplied to said gas turbine, and controls a second opening degree of said pressure control valve based on a pressure of said fuel gas on an output side of said pressure control valve and said first opening degree such that said pressure of said fuel gas supplied to said gas turbine is controlled.

18. The gas turbine system according to claim 17, wherein said control unit determines said first opening degree of said flow rate control valve based on said flow rate of said fuel gas supplied to said gas turbine, determines a first temporary opening degree based on said first opening degree, determines a second temporary opening degree based on said pressure on the output side of said pressure control valve, and determines said second opening degree based on said first and second temporary opening degrees.

19. The gas turbine system according to claim 18, wherein said control unit determines said second opening degree such that said second pressure control valve is always opened as far as said control valve is opened.

20. The gas turbine system according to claim 17, wherein said control unit comprises:

a selector which selects one of said first and second temporary opening degrees as said second opening degree.

21. A steam turbine system comprising:

a steam turbine which comprises a first turbine operating using a main steam and then outputting low temperature re-heated steam, and a second turbine operating high temperature re-heated steam;

a bypass section having a cooler using water to cool a part of said main steam and to produce said low temperature re-heated steam;

a boiler which generates said main steam to supply to said steam turbine and heats said low temperature re-heated steam from said steam turbine and said bypass section to produce and supply said high temperature re-heated steam to said steam turbine; and a pressure and flow control apparatus which has a pressure control valve and a temperature control valve which are connected in series, controls a first opening degree of said temperature control valve based on a temperature of an output of said cooler such that supply of said water to said cooler is controlled, and controls a second opening degree of said pressure control valve based on a pressure on an output side of said pressure control valve and said first opening degree such that said pressure of said water supplied to said cooler is controlled.

22. The steam turbine system according to claim 21, wherein said control unit determines said first opening degree of said flow rate control valve based on the temperature of the output of said cooler, determines a first temporary opening degree based on said first opening degree, determines a second temporary opening degree based on said pressure on the output side of said pressure control valve, and determines said second opening degree based on said first and second temporary opening degrees.

23. The steam turbine system according to claim 21, wherein said control unit determines said second opening degree such that said second pressure control valve is always opened as far as said temperature control valve is opened.

24. The steam turbine system according to claim 22, wherein said control unit comprises:

a selector which selects one of said first and second temporary opening degrees as said second opening degree.

* * * * *